US009308753B2

(12) United States Patent
Nakano

(10) Patent No.: US 9,308,753 B2
(45) Date of Patent: Apr. 12, 2016

(54) INKJET RECORDING METHOD, AND PRINTED MATERIAL

(71) Applicant: FUJIFILM Corporation, Tokyo (JP)

(72) Inventor: Ryoichi Nakano, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/819,674

(22) Filed: Aug. 6, 2015

(65) Prior Publication Data

US 2016/0075148 A1 Mar. 17, 2016

(30) Foreign Application Priority Data

Sep. 16, 2014 (JP) ..... 2014-187407

(51) Int. Cl.

| | |
|---|---|
| ***B41J 2/01*** | (2006.01) |
| ***B05D 1/00*** | (2006.01) |
| ***B05D 1/02*** | (2006.01) |
| ***B41J 11/00*** | (2006.01) |

(52) U.S. Cl.

CPC ..... *B41J 11/002* (2013.01)

(58) Field of Classification Search

CPC ... B41J 11/002; B05D 7/572; C09D 2205/31; G02B 1/118; Y10T 428/269; Y10T 428/273

USPC ..... 347/16, 102; 427/2.31, 209, 427.4, 487, 427/492, 493, 511, 521, 522, 558; 428/32.39, 98, 339, 421

See application file for complete search history.

(56) References Cited

U.S. PATENT DOCUMENTS

| | | | | |
|---|---|---|---|---|
| 7,128,989 | B2 * | 10/2006 | Hashimoto | G11B 5/7021 428/844.5 |
| 7,935,473 | B2 * | 5/2011 | Iwai | B41C 1/1008 101/450.1 |
| 8,151,705 | B2 * | 4/2012 | Taguchi | B41C 1/1008 101/457 |
| 8,747,958 | B2 * | 6/2014 | Yokoi | C09D 7/125 427/511 |

FOREIGN PATENT DOCUMENTS

| | | | |
|---|---|---|---|
| JP | 09-175009 | A | 7/1997 |
| JP | 2005-238035 | A | 9/2005 |
| JP | 2012-125978 | A | 7/2012 |

* cited by examiner

*Primary Examiner* — Anh T. N. Vo

(74) *Attorney, Agent, or Firm* — Sughrue Mion, PLLC

(57) ABSTRACT

An inkjet recording method comprising, in order, as step a an application step of providing an undercoat layer by applying an undercoat composition onto a recording medium, as step b an image formation step of forming an image by discharging an ink composition onto the undercoat layer, as step c a curing step of irradiating the undercoat layer and the ink composition with actinic radiation so as to carry out curing, the undercoat composition comprising an isocyanate group-containing compound, a radically polymerizable monomer, and a radical polymerization initiator, and the ink composition comprising a radically polymerizable monomer, a radical polymerization initiator, and a colorant.

12 Claims, 1 Drawing Sheet

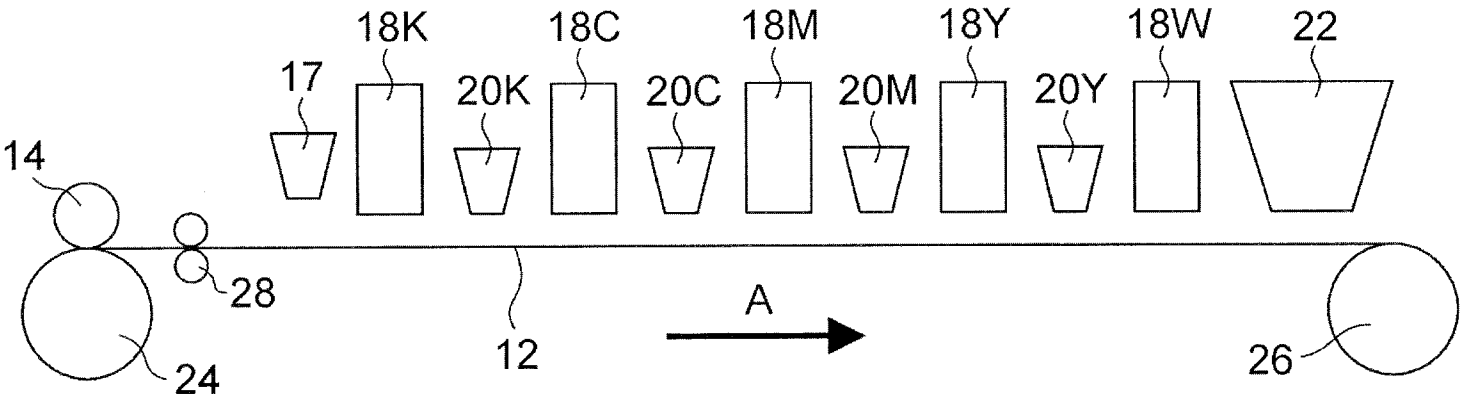
22
18W
20Y
18Y
20M
18M
20C
18C
20K
18K
17
28
14
24
26
12
A

INKJET RECORDING METHOD, AND PRINTED MATERIAL

CROSS-REFERENCE TO RELATED APPLICATIONS

This application claims priority under U.S.C. 119 from Japanese Patent Application No. 2014-187407 filed on Sep. 16, 2014, the entire contents of which are incorporated by reference herein.

TECHNICAL FIELD

The present invention relates to an inkjet recording method, and a printed material.

BACKGROUND ART

As image recording methods for forming an image on a recording medium such as paper based on an image data signal, there are an electrophotographic system, sublimation type and melt type thermal transfer systems, an inkjet system, etc.

With regard to the inkjet system, the printing equipment is inexpensive, it is not necessary to use a plate when printing, and since an image is formed directly on a recording medium by discharging an ink composition only on a required image area, the ink composition can be used efficiently and the running cost is low, particularly in the case of small lot production. Furthermore, there is little noise and it is excellent as an image recording system, and has been attracting attention in recent years.

Among them, an inkjet recording ink composition (radiation-curing inkjet recording ink composition), which is curable upon exposure to radiation such as UV rays, is an excellent system from the viewpoint of it being possible to print on various types of recording media because, compared with a solvent-based ink composition, the drying properties are excellent and an image is resistant to spreading since the majority of the components in the ink composition cure upon exposure to radiation such as UV rays.

Printing of flexible packaging has until now mainly been carried out by a conventional printing method such as gravure printing or flexographic printing. However, in recent years digital printing, to meet the increase in small lot printing, has been attracting attention in the field of flexible packaging also. In the case of digital printing, it is unnecessary to make a plate, it is also unnecessary to carry out color matching, and in the case of small lot printing in particular it is possible to achieve a low cost and, moreover, since the preparation time can be cut it results in a reduction in printing time.

Examples of conventional inkjet recording methods include those described in JP-A-9-175009 (JP-A denotes a Japanese unexamined patent application publication), JP-A-2012-125978 or JP-A-2005-238035.

DISCLOSURE OF INVENTION

Problems to be Solved by the Invention

It is an object of the present invention to provide an inkjet recording method that can give a printed material having good adhesion and excellent blocking inhibition, and a printed material.

Means for Solving the Problems

The object of the present invention has been attained by means described in <1>, <8> and <9> below. They are described below together with <2> to <7>, which are preferred embodiments.

<1> An inkjet recording method comprising, in order, as step a an application step of providing an undercoat layer by applying an undercoat composition onto a recording medium, as step b an image formation step of forming an image by discharging an ink composition onto the undercoat layer, as step c a curing step of irradiating the undercoat layer and the ink composition with actinic radiation so as to carry out curing, the undercoat composition comprising an isocyanate group-containing compound, a radically polymerizable monomer, and a radical polymerization initiator, and the ink composition comprising a radically polymerizable monomer, a radical polymerization initiator, and a colorant, <2> The inkjet recording method according to <1>, wherein the content of a polyfunctional ethylenically unsaturated compound in the undercoat composition is at least 70 mass % relative to the total content of the radically polymerizable monomer, and the content of a polyfunctional ethylenically unsaturated compound in the ink composition is at least 70 mass % relative to the total content of the radically polymerizable monomer.

<3> The inkjet recording method according to <1> or <2>, wherein the ink composition and the undercoat composition comprise an acylphosphine compound as the radical polymerization initiator, <4> The inkjet recording method according to any one of <1> to <3>, wherein in step a the undercoat composition is applied onto the recording medium within one day after preparation, <5> The inkjet recording method according to any one of <1> to <4>, wherein it is for package printing, <6> The inkjet recording method according to any one of <1> to <5>, wherein the recording medium is a resin film that has a film thickness of 10 to 90 μm and has an image formation face comprising at least one type of resin selected from the group consisting of polyethylene, polypropylene, polyethylene terephthalate, and nylon, <7> The inkjet recording method according to any one of <1> to <6>, wherein it further comprises, as step d subsequent to step c, a lamination step of forming an adhesive layer and a laminate film above the image, <8> A printed material obtained by the inkjet recording method according to any one of <1> to <7>, <9> A printed material comprising, in order above a printed material obtained by the inkjet recording method according to any one of <1> to <6>, an adhesive layer and a laminate film.

In accordance with the present invention, there can be provided an inkjet recording method that can give a printed material having good adhesion and excellent blocking inhibition, and a printed material.

BRIEF DESCRIPTION OF DRAWINGS

FIG. 1: A schematic drawing showing one example of inkjet recording equipment suitably used in the present invention.

MODES FOR CARRYING OUT THE INVENTION

Inkjet Recording Method

The inkjet recording method of the present invention comprises, in order, as step a an application step of providing an undercoat layer by applying an undercoat composition onto a recording medium, as step b an image formation step of forming an image by discharging an ink composition onto the undercoat layer, as step c a curing step of irradiating the undercoat layer and the ink composition with actinic radiation so as to carry out curing, the undercoat composition comprising an isocyanate group-containing compound, a radically polymerizable monomer, and a radical polymerization initiator, and the ink composition comprising a radically polymerizable monomer, a radical polymerization initiator, and a colorant.

Furthermore, the inkjet recording method of the present invention is suitable for printing of flexible packaging, more suitable for packaging printing of food packaging.

The present inventors have found that, in food packaging printing for flexible packaging in particular, when an image is formed by a conventional inkjet recording method, there are the problems that image adhesion and blocking inhibition are insufficient. As a result of an intensive investigation by the present inventors, it has been found that an image having good adhesion and excellent blocking inhibition is obtained by forming an undercoat layer using an undercoat composition comprising an isocyanate group-containing compound, a radically polymerizable monomer, and a radical polymerization initiator, and forming an image by discharging an ink composition thereonto.

In the present specification, 'A to B', which expresses a numerical range, has the same meaning as 'at least A but no greater than B'. Furthermore, 'as step a an application step of providing an undercoat layer by applying an undercoat composition onto a recording medium' is also called simply 'step a'.

Furthermore, in the present invention, 'mass %' and 'wt %' have the same meaning, and 'parts by mass' and 'parts by weight' have the same meaning.

Moreover, in the present invention '(meth)acrylate' means both or either of 'acrylate' and 'methacrylate', and '(meth) acrylic' means both or either of 'acrylic' and 'methacrylic'.

In the present invention, combinations of preferable embodiments described below are more preferable.

The present invention is explained in detail below.

Step a: An Application Step of Providing an Undercoat Layer by Applying an Undercoat Composition onto a Recording Medium The inkjet recording method of the present invention comprises as step a an application step of providing an undercoat layer by applying an undercoat composition onto a recording medium.

The undercoat composition comprises an isocyanate group-containing compound, a radically polymerizable monomer, and a radical polymerization initiator.

A preferred mode of the undercoat composition in the present invention is explained in detail later.

The recording medium (substrate, support, recording material, etc.) used in the inkjet recording method of the present invention is not particularly limited and a known recording medium may be used. Among them, transparent medium is preferably used for packaging printing of food packaging.

In the present invention, being 'transparent' means having a visible light transmittance of at least 80%, and preferably a visible light transmittance of at least 90%. The transparent recording medium may be colored as long as it is transparent, but is preferably a colorless recording medium.

Specific examples of the recording medium include glass, quartz, and a plastic film (e.g. cellulose diacetate, cellulose triacetate, cellulose propionate, cellulose butyrate, cellulose acetate butyrate, cellulose nitrate, an acrylic resin, a chlorinated polyolefin resin, a polyether sulfone resin, polyethylene terephthalate (PET), polyethylene naphthalate, a polyolefin resin, a polyester resin, a polyamide resin, a porystylene, a polycycloolefin resin, a polyimide resin, a polycarbonate resin, polyvinyl acetal. etc).

Furthermore, as the transparent recording medium, a mixture of two or more types of the above resins or one formed by layering at least two of these resins may be used.

Among them, the recording medium is preferably a recording medium having an image formation face comprising at least one type of resin selected from the group consisting of a polyolefin resin, a polyester resin, and a polyamide resin, more preferably a recording medium having an image formation face comprising at least one type of resin selected from the group consisting of polyethylene terephthalate, polyethylene, polypropylene and nylon, yet more preferably a recording medium comprising at least one type of resin selected from the group consisting of polyethylene terephthalate, polyethylene, polypropylene and nylon.

As the polyethylene, LDPE (low-density polyethylene), MDPE (medium-density polyethylene), or HDPE (high-density polyethylene) is preferably used; as the polypropylene, CPP (cast polypropylene), OPP (biaxially oriented polypropylene), KOP (polyvinylidene chloride-coated OPP), or AOP (PVA-coated OPP) is preferably used; as the PET, biaxially oriented polyester is preferably used; and as the nylon, ON (oriented nylon), KON (oriented nylon), or CN (cast nylon) is preferably used.

In addition, a combination of EVA (ethylene/vinyl acetate copolymerization film), PVA (Vinylone), EVOH (polyvinyl alcohol), PVC (polyvinyl chloride), PVDC (polyvinylidene chloride, Saran), Cellophane (PT, MST, and K Cello), ZX (Zekuron (polyacrylonitrile, PAN)), and PS (polystyrene and styryl) is preferably used.

According to the applications of the package, optimal materials are selected, and a film in a multilayer structure may be made so as to prepare a film having a combination of the characteristics of the respective materials.

In addition, for the purpose of improvement of the strength of the package, oxygen blocking, or the like, AL (aluminum foil), a VM film (aluminum-deposited film, a transparent deposited film), or the like can also be incorporated in the multiplayer surface.

In addition, recently, a co-extruded film formed by extruding the resins together from two or more parallel slits and performing film formation and lamination at once is also preferably used. Lamination can be carried out to make at most 5 to 7 layers even a thin layer in several μm that cannot be used to make a film form, and therefore, films that can be used in various performance and applications are made.

The thickness of the recording medium is not particularly limited, but is preferably 1 to 500 μm, more preferably 2 to 200 μm, yet more preferably 5 to 100 μm, and particularly preferably 10 to 90 μm.

In the inkjet recording method of the present invention, as means for applying the transparent ink on top of the recording medium, a coating machine, an inkjet nozzle, etc. may be used, and a coating machine is preferably used.

The coating machine is not particularly limited and may be appropriately selected from known coating machines according to the intended purpose, etc., and examples thereof include an air doctor coater, a blade coater, a rod coater, a knife coater, a squeegee coater, an immersion coater, a reverse roll coater, a transfer roll coater, a gravure coater, a kiss roll coater, a cast coater, a spray coater, a curtain coater, and an extrusion coater. Details may be referred to in 'Kotingu Kogaku (Coating Engineering)' by Yuji Harasaki.

Among them, in terms of equipment cost, application of the transparent ink on top of the recording medium is preferably carried out by coating using a relatively inexpensive bar coater or spin coater.

The undercoat composition is preferably applied to the same region as the image formed on the recording medium by means of the ink composition in Step b or to a wider region than that of the image, and is preferably applied so as to cover the entire face of a region on which an image can be formed.

The amount of undercoat composition applied (mass per unit area) is preferably at least 0.05 g/m$^2$ but no greater than 5 g/m$^2$, and more preferably at least 0.06 g/m$^2$ but no greater than 3 g/m$^2$. It is preferable for the amount of undercoat composition applied to be in the above-mentioned range since a printed material having sufficient improving effect of adhesion and excellent flexibility is obtained.

Furthermore, with regard to the amount of undercoat composition applied (ratio by mass per unit area), it is preferably at least 0.05 but no greater than 5 when the maximum amount of colored liquid composition applied (per color) is 1, is more preferably at least 0.07 but no greater than 4, and is yet more preferably at least 0.1 but no greater than 3.

Step a': Semi-Curing Step of Irradiating Applied Undercoat Composition with Actinic Radiation to Thus Carry Out Semi-Curing The inkjet recording method of the present invention preferably comprises, as step a' between step a and step b, a semi-curing step of irradiating an applied undercoat composition with actinic radiation to thus carry out semi-curing.

Due to it comprising the semi-curing step, even when an undercoat composition having a low content of the isocyanate compound is used, an image having high adhesion can be formed.

In the present invention, 'semi-curing' means a partial cure (partially cured; partial curing) and denotes a state in which an undercoat composition (undercoat layer) and/or an ink composition (hereinafter, also simply called an 'ink'), which is described later, applied to a recording medium is partially cured or is not completely cured. When an undercoat composition or an ink composition discharged onto an undercoat composition is semi-cured, the degree of curing may be non-uniform. For example, it is preferable that curing of an undercoat composition and/or an ink composition progresses in the depth direction.

Examples of methods for semi-curing an undercoat layer include a method in which actinic radiation is applied to the undercoat layer, that is, a method of causing a curing reaction by an exposure.

As the actinic radiation, a rays, y rays, an electron beam, X rays, visible light, infrared light, etc. may be used other than ultraviolet rays. Among them, ultraviolet rays or visible light are preferable, and ultraviolet rays are more preferable.

The amount of energy necessary for semi-curing the undercoat layer depends on the type and content of a radical polymerization initiator, but it is preferably on the order of 1 to 500 mJ/cm$^2$ when energy is provided by actinic radiation.

As an exposure source, a mercury lamp, a gas/solid laser, etc. are mainly used, and for UV photocuring inkjet ink a mercury lamp and a metal halide lamp are widely known. However, from the viewpoint of protection of the environment, there has recently been a strong desire for mercury not to be used, and replacement by a GaN semiconductor UV light emitting device is very useful from industrial and environmental viewpoints. Furthermore, LEDs (UV-LED) and LDs (UV-LD) have small dimensions, long life, high efficiency, and low cost, and their use as a photocuring inkjet light source can be expected.

Furthermore, light-emitting diodes (LED) and laser diodes (LD) may be used as the source of actinic radiation. In particular, when a UV ray source is needed, a UV-LED or a UV-LD may be used. For example, Nichia Corporation has marketed a violet LED having a wavelength of the main emission spectrum of between 365 nm and 420 nm. Furthermore, when a shorter wavelength is needed, the example of the LED includes a LED, disclosed in U.S. Pat. No. 6,084,250, that can emit actinic radiation whose wavelength is centered between 300 nm and 370 nm. Furthermore, another violet LED is available, and irradiation can be carried out with radiation of a different UV bandwidth. The actinic radiation source preferable in the present invention is a UV-LED, and a UV-LED having a peak wavelength at 340 to 400 nm is particularly preferable.

The maximum illumination intensity of the LED on a recording medium is preferably 10 to 2,000 mW/cm$^2$, more preferably 20 to 1,000 mW/cm$^2$, and particularly preferably 50 to 800 mW/cm$^2$.

Examples of exposure means suitable for semi-curing an undercoat layer include a metal halide lamp, a mercury lamp, and an LED light source. Among others, an LED light source is preferable. The inkjet recording method of the present invention is suitable for flexible packaging, and it is preferable to use a recording medium having a relatively small film thickness for flexible packaging as described above. In this case, it is preferable to use a UV-LED light source since thermal deformation and shrinkage of the recording medium are suppressed.

In the present invention, when a radically photopolymerizable undercoat layer is used in the presence of oxygen, which inhibits radical polymerization, thus carrying out partial photocuring, curing of the undercoat layer advances further in the interior than in the exterior.

In particular, the polymerization reaction is easily inhibited on the surface of the undercoat layer compared with the interior thereof due to the influence of oxygen in the air. It is therefore possible to semi-cure the undercoat layer by controlling the conditions under which actinic radiation is applied.

Due to the actinic radiation, generation of an active species as a result of decomposition of a radical polymerization initiator is promoted, and as a result of an increase in the active species or an increase in temperature a curing reaction by polymerization or crosslinking, by means of the active species, of a polymerizable or crosslinking material is promoted.

Furthermore, increasing the viscosity (viscosity increase) is also suitably carried out by irradiation with actinic light.

In the semi-curing step, when a curing reaction is based on an ethylenically unsaturated compound, the degree of unpolymerization may, as described later, be measured quantitatively by the reaction ratio of an ethylenically unsaturated group.

When a semi-cured state of the undercoat layer is realized by a polymerization reaction of a ethylenically unsaturated compound for which polymerization is initiated by irradiation with actinic radiation, from the viewpoint of improvement of scratch resistance of a printed material, it is preferable for the degree of unpolymerization (A (after polymerization)/A (before polymerization)) to be at least 0.2 but no greater than 0.9, more preferably at least 0.3 but no greater than 0.9, and particularly preferably at least 0.5 but no greater than 0.9.

Here, A (after polymerization) is an infrared absorption peak due to a ethylenically unsaturated group after the polymerization reaction, and A (before polymerization) is an infrared absorption peak due to the ethylenically unsaturated group before the polymerization reaction. For example, when the ethylenically unsaturated compound contained in the undercoat layer is an acrylate monomer or a methacrylate monomer, an absorption peak due to the polymerizable group (acrylate group, methacrylate group) is observed at around 810 $cm^{-1}$, and the degree of unpolymerization is preferably defined by the absorbance of the peak.

Moreover, as means for measuring an infrared absorption spectrum, a commercial infrared spectrophotometer may be used; either a transmission type or a reflectance type may be used, and it is preferably selected as appropriate depending on the form of a sample. For example, an FTS-6000 infrared spectrophotometer manufactured by Bio-Rad Laboratories, Inc. may be used for measurement.

Furthermore, step a and/or step a' above are preferably carried out under a humidity of at least 20%, and more preferably under a humidity of at least 30%.

Under the conditions above, a printed material having excellent adhesion can be obtained.

Step b: Image Formation Step of Forming Image by Discharging Ink Composition onto Undercoat Layer The inkjet recording method of the present invention comprises as step b an image formation step of forming an image by discharging an ink composition onto an undercoat layer.

Due to the ink composition being discharged onto the undercoat layer, an image having good adhesion can be obtained.

As means for applying an ink composition, an inkjet head is preferably used. Preferred examples of the inkjet head include heads employing a charge control system in which an ink is discharged by utilizing an electrostatic attraction force, a drop-on-demand system (pressure pulse system) in which oscillatory pressure of a piezo element is utilized, an acoustic inkjet system in which an electrical signal is changed into an acoustic beam and applied to an ink, and the ink is discharged by utilizing radiation pressure, a thermal inkjet (Bubblejet (registered trademark)) in which a bubble is formed by heating an ink and the pressure thus generated is utilized, etc.

In the image formation step, the ink composition discharges by an inkjet recording method onto the undercoat layer.

An inkjet recording device used in the inkjet recording method of the present invention is not particularly limited, and any known inkjet recording device that can achieve an intended resolution may be used. That is, any known inkjet recording device, such as a commercial product, may be used in order to discharge an ink composition onto a recording medium in the image formation step of the inkjet recording method of the present invention.

The inkjet recording device that can be used in the present invention is equipped with, for example, an ink supply system, a temperature sensor, and an actinic radiation source.

The ink supply comprises, for example, a main tank containing the ink composition of the present invention, a supply pipe, an ink composition supply tank immediately before an inkjet head, a filter, and a piezo system inkjet head. The piezo system inkjet head may be driven so as to discharge a multi-size dot of preferably 1 to 100 pL, more preferably 3 to 42 pL, and yet more preferably 8 to 30 pL, at a resolution of preferably 320×320 to 4,000×4,000 dpi, more preferably 400×400 to 1,600×1,600 dpi, and yet more preferably 720×720 dpi. Here, dpi referred to in the present invention means the number of dots per 2.54 cm.

Since it is desirable for the ink composition of the present invention to be discharged at a constant temperature, the inkjet recording equipment is preferably equipped with a temperature stabilizer for stabilizing the temperature of the inks. Parts to be controlled to a constant temperature include all of the supply pipe system and the members from the ink tank (including an intermediate tank if it is provided) to the discharging face of the nozzle. A section from the ink supply tank to the inkjet head is thermally insulated and heated.

A method of controlling temperature is not particularly limited, but it is preferable to provide, for example, temperature sensors at a plurality of pipe section positions, and control heating according to the ink composition flow rate and the temperature of the surroundings. The temperature sensors may be provided on the ink composition supply tank and in the vicinity of the inkjet head nozzle. Furthermore, the head unit that is to be heated is preferably thermally shielded or insulated so that the device main body is not influenced by the temperature of the outside air. In order to reduce the printer start-up time required for heating, or in order to reduce the thermal energy loss, it is preferable to thermally insulate the head unit from other sections and also to reduce the heat capacity of the entire heated unit.

It is preferably to maintain the ink composition discharge temperature as constant as possible. In the present invention, the control range for the temperature of ink composition is preferably ±5° C. of a set temperature, more preferably ±2° C. of the set temperature, and yet more preferably ±1° C. of the set temperature.

The droplet firing interval until a droplet of an ink composition is fired after applying an undercoat composition is preferably at least 5 psec but no greater than 10 sec. The droplet firing interval of ink composition droplets is more preferably at least 10 psec but no greater than 5 sec, and particularly preferably at least 20 psec but no greater than 5 sec.

The inkjet recording method of the present invention may comprise a step of semi-curing the discharged ink composition after carrying out image formation by discharging the ink composition onto the undercoat layer, but when the curing step is carried out immediately thereafter, it is preferable for it not to comprise this semi-curing step.

Furthermore, in the inkjet recording method of the present invention, one type of the ink composition may be used on its own or two or more types thereof may be used.

For example, when a color image is formed, it is preferable to use at least yellow, cyan, magenta, and black ink compositions, and it is more preferable to use white, yellow, cyan, magenta, and black ink compositions.

Furthermore, a light color ink composition such as light magenta or light cyan, a special color ink composition such as orange, green, or violet, a clear ink composition, a metallic ink composition, etc. may be used.

In the inkjet recording method of the present invention, when two or more types of ink compositions are discharged, it is preferable for it to comprise a step of semi-curing the discharged ink composition after discharging one type of ink composition but before discharging another type of ink composition. That is, the inkjet recording method of the present invention preferably comprises, for each of the ink compositions used, a step of discharging an ink composition onto the undercoat layer and a step of semi-curing the discharged ink composition. When in this mode, the effects of the present invention can be further exhibited.

Furthermore, when two or more types of ink compositions are discharged, the semi-curing step is carried out by irradiation with actinic radiation, and in a preferred embodiment thereof the exposure conditions and the exposure equipment in step a' above are used, preferred embodiments also being the same.

Furthermore, when the curing step is carried out immediately thereafter, the inkjet recording method of the present invention may comprise a step of semi-curing the last-discharged ink composition or may not comprise it, but from the viewpoint of cost and simplicity, it is preferable for it not to comprise it.

Moreover, when two or more types of ink compositions are discharged, it is preferable to discharge any of the ink compositions onto the semi-cured undercoat layer, onto the discharged ink composition, or onto the semi-cured ink composition. That is, it is preferable to discharge any of the ink compositions onto the undercoat layer directly or via another ink composition layer. Furthermore, from the viewpoint of adhesion, it is preferable that the undercoat layer is semi-cured.

The inkjet recording method of the present invention may suitably employ the ink set comprising at least one ink composition of the present invention. The order in which colored ink compositions are discharged is not particularly limited, but it is preferable to apply to a recording medium from a colored ink composition having a low lightness; when the ink compositions of yellow, cyan, magenta, and black are used, they are preferably applied on top of the recording medium in the order black→magenta→cyan→yellow. Furthermore, when white is additionally used, they are preferably applied on top of the recording medium in the order black→magenta→cyan→yellow→white. Moreover, the present invention is not limited thereto, and an ink set comprising a total of seven colors, that is, light cyan, light magenta ink compositions and cyan, magenta, black, white, and yellow dark ink compositions may preferably be used, and in this case they are applied on top of the recording medium in the order black→magenta→cyan→yellow→light magenta→light cyan→white.

Step c: A Curing Step of Irradiating the Undercoat Layer and the Ink Composition with Actinic Radiation so as to Carry Out Curing The inkjet recording method in this invention comprises a curing step of irradiating the undercoat layer and the ink composition with actinic radiation so as to carry out curing. After carrying out this step, undercoat layer and ink compositions are completely cured. Being 'completely cured' in the present invention means a state in which the interior and surface of the undercoat solution and ink composition on the recording medium are completely cured. Specifically, it can be evaluated by pressing plain paper (e.g. copier paper C2, product code V436, Fuji Xerox Co., Ltd.) with a uniform force (a constant value in the range of 500 to 1,000 mN/cm$^2$) after the overall curing step is completed, and examining transfer of the undercoat solution surface to the permeable medium. That is, when there is no transfer at all, it is defined as being in a completely cured state.

The curing step is carried out by irradiation with actinic radiation, and in a preferred embodiment thereof the exposure conditions and the exposure equipment in step a' above are used, preferred embodiments also being the same. That is, the curing step is preferably carried out under an oxygen-deficient atmosphere.

Step d: Lamination Step of Forming Second Adhesive Layer and Laminate Film (a Film for Lamination) Above Ink Composition Layer It is also preferable for the inkjet recording method of the present invention to further comprise a lamination step of forming an adhesive layer and a laminate film above an ink composition layer, as step d subsequent to step c.

Lamination enables leaching of an ink component from a printed material as well as blocking and odor to be suppressed, and it enables the use preferably for food packaging in particular.

The adhesive layer is not particularly limited and can be formed by applying a known adhesive by a known method.

As the laminate film, a resin film is used, and examples include a polyethylene terephthalate film, a polypropylene film, a nylon film, a polyvinyl chloride film, a polyethylene film, and a triacetylcellulose film. These films may be subjected to biaxial stretching.

In this step, a laminate film may be bonded after an adhesive layer is formed on an ink composition or an adhesive layer may first be applied to a laminate film followed by bonding onto an ink composition.

A method of lamination is not particularly limited; a known method may be used, and dry lamination can be cited as an example.

When a resin film is used as a substrate, although it depends on the lamination method chosen, it is preferable to use a resin film that has high adhesion to a resin film used on the face of the substrate that is to be laminated.

(Printed Material)

The printed material of the present invention is preferably a printed material obtained by the inkjet recording method of the present invention.

Furthermore, the printed material of the present invention preferably further comprises, in order above a printed material obtained by the inkjet recording method of the present invention, an adhesive layer and a laminate film.

The adhesive layer and the laminate film have the same meanings as those of the adhesive layer and the laminate film explained for the lamination step, and preferred embodiments are also the same.

(Inkjet Recording Equipment)

Inkjet recording equipment that can be used particularly suitably in the present invention is now explained in further detail. The inkjet recording method of the present invention is suitably carried out by the inkjet recording equipment, which is explained below.

The inkjet recording equipment used in the present invention preferably comprises transport means for transporting a recording medium, application means for applying an undercoat composition onto the recording medium, discharge means for discharging via inkjet an ink composition onto the undercoat composition, and complete curing means for curing the entire undercoat solution and ink composition, and may further comprise semi-curing means for semi-curing the applied undercoat composition.

Furthermore, the inkjet recording equipment used in the present invention is preferably the so-called single-pass inkjet recording equipment.

FIG. 1 is a schematic drawing showing one example of the inkjet recording equipment preferably used in the present invention. The equipment below has an exposure light source 17 for semi-curing an undercoat composition, but equipment that does not have such a semi-curing light source may also be used suitably in the present invention.

A recording medium 12, which is tensioned by an outfeed roller 24 and a wind-up roller 26 as transport means for the recording medium 12, is transported in the direction of arrow A, and an undercoat composition is applied thereonto by an undercoat composition coating roller 14. Subsequently, the undercoat composition is semi-cured by the exposure light source 17 for semi-curing an undercoat composition. Subsequently, ink compositions of each color (K: black, Y: yellow, M: magenta, C: cyan, W: white) are discharged by respective inkjet heads 18K, 18C, 18M, 18Y, and 18W for discharging ink compositions of each color, and the discharged black, yellow, magenta, and cyan ink compositions are semi-cured by semi-curing exposure light sources 20K, 20C, 20M, and 20Y disposed immediately after the inkjet heads 18K, 18C, 18M, and 18Y. Finally, the semi-cured undercoat composition and ink composition are cured overall by exposing the recording medium using nitrogen-purged exposure light source unit 22 under an oxygen-deficient atmosphere.

The nitrogen-purged exposure light source unit 22 is preferably of a mode in which, for example, an LED light source is surrounded by an inert gas blanket and is connected to an inert gas generator via an inert gas pipe, and when the inert gas generator is started the air within the blanket is replaced by the inert gas. The inert gas may employ nitrogen, etc. as already mentioned.

In FIG. 1, in order to improve the transport accuracy, a nip roll 28 is provided. Since the undercoat composition is completely cured, use of a nip roll becomes possible in the inkjet recording method of the present invention, more accurate transport is realized, and misregistration (displacement of landing position) is suppressed. The nip roll 28 is not essential, and image formation equipment having no nip roll may be used.

(Undercoat Composition)

The undercoat composition used in this invention of the present study, comprising an isocyanate group-containing compound, a radically polymerizable monomer, and a radical polymerization initiator.

The undercoat composition used in the present invention is the oleaginous liquid composition that can cure by actinic radiation.

<Isocyanate Group-Containing Compound>

The isocyanate group-containing compound used in the undercoat composition of the present invention is not particularly limited, and a known isocyanate compound may be used. It may be either an aliphatic or aromatic isocyanate, but from the viewpoint of safety and stability an aliphatic isocyanate is preferable.

Furthermore, as the isocyanate compound used in the present invention, a commercial product may be used.

Preferred examples include the Takenate series such as Takenate D103H, D204, D160N, D170N, D165N, D178NL, and D110N (Mitsui Chemical Co., Ltd.) and Coronate HX, HXR, HXL, HXLV, HK, HK-T, HL, and 2096 (Nippon Polyurethane Industry Co., Ltd.).

Furthermore, a commercially available two-component adhesive comprising an isocyanate compound and a polyol compound, which is described later, such as TM-550 and CAT-RT-37-2K (Toyo-Morton, Ltd.), or an X series solvent-free adhesive such as XC233-2 and XA126-1 (Dainichiseika Color & Chemicals Mfg. Co., Ltd.) may also be used.

The amount of isocyanate compound added is preferably 2 to 90 mass % relative to the total mass of the undercoat composition, more preferably 5 to 80 mass %, and yet more preferably 10 to 75 mass %.

<Radically Polymerizable Monomers>

Furthermore, examples of the radically polymerizable monomer used in the undercoat compound of the present invention preferably include an ethylenically unsaturated compound and a known ethylenic compound may be used, and examples thereof include a (meth)acrylate compound, a vinyl ether compound, an allyl compound, an N-vinyl compound, and an unsaturated carboxylic acid. There can be cited, for example, radically polymerizable monomers described in JP-A-2009-221414, polymerizable compounds described in JP-A-2009-209289, and ethylenically unsaturated compounds described in JP-A-2009-191183.

The ethylenically unsaturated compound is preferably a (meth)acrylate compound, and more preferably an acrylate compound.

The undercoat composition preferably comprises at least 70 mass % of a polyfunctional ethylenically unsaturated compound relative to the total content of the radically polymerizable monomer. Within this range, the occurrence of odor can be suppressed.

Furthermore, it is preferable for the composition to comprise a polyfunctional ethylenically unsaturated compound from the viewpoint of curability and flexibility.

In the present invention, the undercoat composition preferably comprises as the polyfunctional ethylenically unsaturated compound a polyfunctional (meth)acrylate compound, more preferably comprises a difunctional (meth)acrylate compound, yet more preferably comprises a difunctional acrylate compound, and particularly preferably comprises a diacrylate monomer since it has low viscosity and excellent reactivity.

In the present invention, the monomer means a radically polymerizable compound having a viscosity at room temperature (25° C.) of less than 0.1 Pa·s. The monomer preferably has a molecular weight (weight-average molecular weight where there is molecular weight distribution) of less than 1,000, and the oligomer usually means a polymer in which a limited number (usually 5 to 100) of monomers are bonded and preferably has a weight-average molecular weight of at least 1,000.

Preferred examples of the polyfunctional ethylenically unsaturated compound include a di(meth)acrylic acid ester of an aliphatic hydrocarbon diol having 6 to 12 carbons (difunctional (meth)acrylate compound). The hydrocarbon diol may be any of a straight-chain hydrocarbon diol, a branched hydrocarbon diol, and a cyclic hydrocarbon diol, and preferred examples include a straight-chain hydrocarbon diol and a branched hydrocarbon diol.

The di(meth)acrylic acid ester of an aliphatic hydrocarbon diol having 6 to 12 carbons is preferable since its viscosity is low and its odor is relatively low.

Preferred examples of the di(meth)acrylic acid ester of an aliphatic hydrocarbon diol having 6 to 12 carbons include 1,6-hexanediol di(meth)acrylate, 1,7-heptanediol di(meth) acrylate, 1,8-octanediol di(meth)acrylate, 1,9-nonanediol di(meth)acrylate, 1,10-decanediol di(meth)acrylate, 1,12-dodecanediol di(meth)acrylate, 3-methyl-1,5-pentanediol di(meth)acrylate, 2-n-butyl-2-ethyl-1,3-propanediol di(meth)acrylate, cyclohexanedimethanol di(meth)acrylate, and tricyclodecanedimethanol di(meth)acrylate.

Among them, decanediol diacrylate, dodecanediol diacrylate, and 3-methyl-1,5-pentanediol diacrylate are more preferable, and 3-methyl-1,5-pentanediol diacrylate is yet more preferable.

Furthermore, in the present invention, the (meth)acrylate monomer means a compound containing at least one (meth) acryloyloxy group per molecule and having a viscosity at room temperature (25° C.) of less than 0.1 Pa·s. When the viscosity is within this range, a balance can be achieved between suppression of migration and odor of a printed material and reactivity.

Specific examples of the other difunctional (meth)acrylate compound include dipropylene glycol di(meth)acrylate, tetraethylene glycol di(meth)acrylate, neopentyl glycol di(meth)acrylate, an ethylene oxide (EO)-modified neopentyl glycol di(meth)acrylate, a propylene oxide (PO)-modified neopentyl glycol di(meth)acrylate, a EO-modified hexanediol di(meth)acrylate, a PO-modified hexanediol di(meth) acrylate, tripropylene glycol di(meth)acrylate, and triethylene glycol di(meth)acrylate.

Specific examples of the tri- or higher-functional (meth) acrylate compound include pentaerythritol tri(meth)acrylate, pentaerythritol tetra(meth)acrylate, dipentaerythritol tetra (meth)acrylate, trimethylolethane tri(meth)acrylate, trimethylolpropane tri(meth)acrylate, tetramethylolmethane tetra (meth)acrylate, and oligoester (meta)acrylate.

(a Monofunctional Ethylenically Unsaturated Compound)

The undercoat composition may include a monofunctional ethylenically unsaturated compound as the radically polymerizable monomers. Examples of monofunctional ethylenically unsaturated compounds include a monofunctional (meth)acrylate, a monofunctional (meth)acrylamide, an monofunctional aromatic vinyl compound, a monofunctional vinyl ether (triethylene glycol divinyl ether, etc.), and a monofunctional N-vinyl compound (N-vinyl caprolactam, etc.), etc.

Specific examples of monofunctional (meth)acrylates include hexyl (meth)acrylate, 2-ethylhexyl (meth)acrylate, tert-octyl (meth)acrylate, isoamyl (meth)acrylate, decyl (meth)acrylate, isodecyl (meth)acrylate, stearyl (meth)acrylate, isostearyl (meth)acrylate, cyclohexyl (meth)acrylate, 4-n-butylcyclohexyl (meth)acrylate, bornyl (meth)acrylate, isobornyl (meth)acrylate, benzyl (meth)acrylate, 2-ethylhexyldiglycol (meth)acrylate, butoxyethyl (meth)acrylate, 2-chloroethyl (meth)acrylate, 4-bromobutyl (meth)acrylate, cyanoethyl (meth)acrylate, benzyl (meth)acrylate, butoxymethyl (meth)acrylate, 3-methoxybutyl (meth)acrylate, 2-(2-methoxyethoxy)ethyl (meth)acrylate, 2-(2-butoxyethoxy) ethyl (meth)acrylate, 2,2,2-trifluoroethyl (meth)acrylate, 1H,1H,2H,2H-perfluorodecyl (meth)acrylate, 4-butylphenyl (meth)acrylate, phenyl (meth)acrylate, 2,4,5-trimethylphenyl (meth)acrylate, 4-chlorophenyl (meth)acrylate, phenoxymethyl (meth)acrylate, phenoxyethyl (meth)acrylate, glycidyl (meth)acrylate, glycidyloxybutyl (meth)acrylate, glycidyloxyethyl (meth)acrylate, glycidyloxypropyl (meth) acrylate, tetrahydrofurfuryl (meth)acrylate, 2-hydroxyethyl (meth)acrylate, 3-hydroxypropyl (meth)acrylate, 2-hydroxypropyl (meth)acrylate, 2-hydroxybutyl (meth)acrylate, 4-hydroxybutyl (meth)acrylate, 3-hydroxybutyl (meth)acrylate, dimethylaminoethyl (meth)acrylate, diethylaminoethyl (meth)acrylate, dimethylaminopropyl (meth)acrylate, diethylaminopropyl (meth)acrylate, trimethoxysilylpropyl (meth)acrylate, trimethylsilylpropyl (meth)acrylate, polyethylene oxide monomethyl ether (meth)acrylate, oligoethylene oxide monomethyl ether (meth)acrylate, polyethylene oxide (meth)acrylate, oligoethylene oxide (meth)acrylate, an oligoethylene oxide monoalkyl ether (meth)acrylate, a polyethylene oxide monoalkyl ether (meth)acrylate, dipropylene glycol (meth)acrylate, a polypropylene oxide monoalkyl ether (meth)acrylate, an oligopropylene oxide monoalkyl ether (meth)acrylate, 2-(meth)acryloyloxyethylsuccinic acid, 2-(meth)acryloyloxyhexahydrophthalic acid, 2-(meth)acryloyloxyethyl-2-hydroxypropyl phthalate, butoxydiethylene glycol (meth)acrylate, trifluoroethyl (meth)acrylate, perfluorooctylethyl (meth)acrylate, 2-hydroxy-3-phenoxypropyl (meth)acrylate, EO-modified phenol (meth)acrylate, EO-modified cresol (meth)acrylate, EO-modified nonylphenol (meth)acrylate, PO-modified nonylphenol (meth)acrylate, EO-modified 2-ethylhexyl (meth)acrylate, dicyclopentenyl (meth)acrylate, dicyclopentenyloxyethyl (meth) acrylate, dicyclopentanyl (meth)acrylate, (3-ethyl-3-oxetanylmethyl)(meth)acrylate, and phenoxyethylene glycol (meta)acrylate.

Examples of the (meth)acrylamide include (meth)acrylamide, N-methyl (meth)acrylamide, N-ethyl (meth)acrylamide, N-propyl (meth)acrylamide, N-n-butyl (meth)acrylamide, N-t-butyl (meth)acrylamide, N-butoxymethyl (meth) acrylamide, N-isopropyl (meth)acrylamide, N-methylol (meth)acrylamide, N,N-dimethyl (meth)acrylamide, N,N-diethyl (meth)acrylamide, and (meth)acryloylmorpholine.

Specific examples of the aromatic vinyl compound include styrene, methylstyrene, dimethylstyrene, trimethylstyrene, isopropylstyrene, chloromethylstyrene, methoxystyrene, acetoxystyrene, chlorostyrene, dichlorostyrene, bromostyrene, methyl vinylbenzoate, 3-methylstyrene, 4-methylstyrene, 3-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethylhexyl)styrene, 4-(2-ethylhexyl)styrene, allylstyrene, isopropenylstyrene, butenylstyrene, octenylstyrene, 4-t-butoxycarbonylstyrene, and 4-t-butoxy styrene.

More specifically, commercially available or industrially known radically polymerizable or crosslinking monomers, oligomers, and polymers, such as those described in 'Kakyozai Handobukku' (Crosslinking Agent Handbook), Ed. S. Yamashita (Taiseisha, 1981); 'UV/EB Koka Handobukku (Genryo)' (UV/EB Curing Handbook (Starting Materials)) Ed. K. Kato (Kobunshi Kankoukai, 1985); 'UV/EB Koka Gijutsu no Oyo to Shijyo' (Application and Market of UV/EB Curing Technology), p. 79, Ed. RadTech (CMC, 1989); and E. Takiyama 'Poriesuteru Jushi Handobukku' (Polyester Resin Handbook), (The Nikkan Kogyo Shimbun Ltd., 1988) may be used.

With regard to the radically polymerizable monomer, one type may be used on its own or two or more types may be used in combination.

From the viewpoint of achieving a balance between adhesion and blocking inhibition, the total content of the radically polymerizable monomer in the undercoat composition is preferably 10 to 80 mass % of the entire composition, more preferably 15 to 75 mass %, and yet more preferably 20 to 72 mass %.

Furthermore, the content of the polyfunctional monomer in the undercoat composition is preferably at least 70 mass % relative to the total content of the radically polymerizable monomer, more preferably 70 to 100 mass %, and yet more preferably 80 to 100 mass %.

<Binder Polymer>

The undercoat composition may comprise a binder polymer. The binder polymer is preferably an inactive resin that does not have a polymerizable group.

As the binder polymer a known binder polymer such as a polyester-based resin, a polyurethane resin, a vinyl resin, an acrylic resin, or a rubber-based resin may be used, but an acrylic resin is preferable, and an inactive methyl methacrylate homopolymer and/or copolymer is more preferable. Examples include polymethyl methacrylate (molecular weight 10,000, catalog No. 81497; molecular weight 20,000, catalog No. 81498; molecular weight 50,000, catalog No. 81501) and a methyl methacrylate/n-butyl methacrylate copolymer (mass ratio 85/15, molecular weight 75,000; catalog No. 474029) from Aldrich; ELVACITE 2013 (methyl methacrylate/n-butyl methacrylate copolymer, mass ratio 36/64, molecular weight 37,000), 2021, 2614, 4025, 4026, and 4028 from Lucite International; Paraloid DM55 and B66 from Rohm and Haas; and BR113 and 115 from Dianal America.

The weight-average molecular weight (Mw) of the binder polymer is preferably at least 1,000, more preferably 1,000 to 1,000,000, yet more preferably 5,000 to 200,000, and particularly preferably 8,000 to 100,000.

With regard to the binder polymer, one type may be used on its own or two or more types may be used in combination.

The content of the binder polymer is preferably 0.2 to 15 mass % of the entire undercoat composition, and more preferably 1 to 10 mass %.

When the content of the binder polymer is within this range, a printed material having excellent blocking inhibition can be obtained.

<Radical Polymerization Initiator>

The undercoat composition that can be used in the present invention comprises a radical polymerization initiator.

The radical polymerization initiator is preferably a radical photopolymerization initiator.

Examples of the radical polymerization initiator that can be used in the present invention include (a) an aromatic ketone, (b) an acylphosphine compound, (c) an aromatic onium salt compound, (d) an organic peroxide, (e) a thio compound, (f) a hexaarylbiimidazole compound, (g) a ketoxime ester compound, (h) a borate compound, (i) an azinium compound, (j) a metallocene compound, (k) an active ester compound, (l) a compound having a carbon-halogen bond, (m) an alkylamine compound, etc. With regard to these radical polymerization initiators, the above-mentioned compounds (a) to (m) may be used singly or in combination. Examples of the radical polymerization initiator include compounds described in paragraphs 0090 to 0116 of JP-A-2009-185186.

The radical polymerization initiator that can be used in the present invention is preferably used singly or in a combination of two or more types.

The radical polymerization initiator is preferably an acylphosphine compound, an α-hydroxyketone compound, and/or an α-aminoketone compound. Among them, an acylphosphine compound and/or an α-aminoketone compound is more preferable, and an acylphosphine compound is yet more preferable.

Preferred examples of the acylphosphine compound include bis(2,4,6-trimethylbenzoyl)phenylphosphine oxide, bis(2,6-dimethylbenzoyl)phenylphosphine oxide, bis(2,4,6-trimethylbenzoyl)-2-methoxyphenylphosphine oxide, bis(2,6-dimethylbenzoyl)-2-methoxyphenylphosphine oxide, bis(2,4,6-trimethylbenzoyl)-2,4-dimethoxyphenylphosphine oxide, bis(2,6-dimethylbenzoyl)-2,4-dimethoxyphenylphosphine oxide, bis(2,4,6-trimethylbenzoyl)-2,4-dipentyloxyphenylphosphine oxide, bis(2,6-dimethylbenzoyl)-2,4-dipentyloxyphenylphosphine oxide, 2,4,6-trimethylbenzoylethoxyphenylphosphine oxide, 2,6-dimethylbenzoylethoxyphenylphosphine oxide, 2,4,6-trimethylbenzoylmethoxyphenylphosphine oxide, bis(2,6-trimethoxybenzoyl)-2,4,4-trimethmethylpentylphenylphosphine oxide, 2,4,6-trimethylbenzoyldiphenylphosphine oxide (Lucirin TPO: manufactured by BASF), 2,6-dimethylbenzoylmethoxyphenylphosphine oxide, 2,4,6-trimethylbenzoyl(4-pentyloxyphenyl)phenylphosphine oxide, and 2,6-dimethylbenzoyl(4-pentyloxyphenyl)phenylphosphine oxide.

Among them, as the acylphosphine oxide compound, bis(2,4,6-trimethylbenzoyl)phenylphosphine oxide (Irgacure 819: manufactured by BASF) or bis(2,6-dimethoxybenzoyl)-2,4,4-trimethylpentylphenylphosphine oxide is preferable, and bis(2,4,6-trimethylbenzoyl)phenylphosphine oxide is particularly preferable.

The radically polymerization initiator includes an aromatic ketone compound from the viewpoint of curability.

The aromatic ketone compound is preferably an α-hydroxyketone compound and/or an α-aminoketone compound.

As the α-hydroxyketone compound, a known α-hydroxyketone compound may be used, and examples of the α-hydroxyketone compound include 1-[4-(2-hydroxyethoxy)phenyl]-2-hydroxy-2-methyl-1-propan-1-one, 2-hydroxy-2-methyl-1-phenylpropan-1-one, and 1-hydroxycyclohexyl phenyl ketone compound. Among them, 1-hydroxycyclohexyl phenyl ketone compound is preferable. The 1-hydroxycyclohexyl phenyl ketone compound referred to in the present invention means 1-hydroxycyclohexyl phenyl ketone and a compound obtained by substituting 1-hydroxycyclohexyl phenyl ketone with any substituent. The substituent may be selected freely from a range that enables an ability as a radical polymerization initiator to be exhibited, and specific examples thereof include an alkyl group having 1 to 4 carbons.

As the α-aminoketone compound, a known α-aminoketone compound may be used, and examples of the α-aminoketone compound include 2-methyl-1-phenyl-2-morpholinopropan-1-one, 2-methyl-1-[4-(hexyl)phenyl]-2-morpholinopropan-1-one, 2-methyl-1-(4-methylthiophenyl)-2-morpholinopropan-1-one, 2-ethyl-2-dimethylamino-1-(4-morpholinophenyl)butan-1-one, 2-benzyl-2-dimethylamino-1-(4-morpholinophenyl)butan-1-one, and 2-dimethylamino-2-[(4-methylphenyl)methyl]-1-[4-(4-morpholinyl)phenyl]-1-butanone.

Furthermore, a commercial product such as IRGACURE 907 (2-methyl-1-(4-methylthiophenyl)-2-morpholinopropan-1-one), IRGACURE 369 (2-benzyl-2-dimethylamino-1-(4-morpholinophenyl)-1-butanone), or IRGACURE 379 (2-dimethylamino-2-[(4-methylphenyl)methyl]-1-[4-(4-morpholinyl)phenyl]-1-butanone) (BASF) can be cited as a preferred example.

In the present invention, from the viewpoint of suppression of migration and odor, a radical polymerization initiator having a weight-average molecular weight of 500 to 3,000 may be used in combination. The weight-average molecular weight is preferably 800 to 2,500, and more preferably 1,000 to 2,000. When the molecular weight is at least 500, an ink composition in which leaching of a compound from a cured film is suppressed and migration, odor, and blocking are suppressed can be obtained. On the other hand, when it is no greater than 3,000, there is little steric hindrance in the molecule, the degree of freedom of a molecule in a liquid/film is maintained, and high sensitivity can be obtained.

The weight-average molecular weight is measured by a GPC method (gel permeation chromatograph method) and determined on a reference polystyrene basis. For example, an HLC-8220 GPC (Tosoh Corporation) is used as a GPC, with three columns of TSKgeL SuperHZM-H, TSKgeL SuperHZ4000, and TSKgeL SuperHZ2000 (4.6 mm ID×15 cm, Tosoh Corporation) as columns, and THF (tetrahydrofuran) as eluent. The conditions are such that the sample concentration is 0.35 mass %, the flow rate is 0.35 mL/min, the amount of sample injected is 10 μL, the measurement temperature is 40° C., and an IR detector is used. Furthermore, a calibration curve is generated from eight samples of 'reference sample TSK standard, polystyrene', that is, 'F-40', 'F-20', 'F-4', 'F-1', 'A-5000', 'A-2500', 'A-1000', and 'n-propylbenzene' manufactured by Tosoh Corporation.

Examples of radical polymerization initiators having a weight-average molecular weight of 500 to 3,000 as a molecular weight include SPEEDCURE 7010 (1,3-di({α[1-chloro-9-oxo-9H-thioxanthen-4-yl]oxy}acetylpoly[oxy(1-methylethylene)])oxy)-2,2-bis({α-[1-chloro-9-oxo-9H-thioxanthen-4-yl]oxy}acetylpoly[oxy(l-methylethylene)])oxymethyl)propane, CAS No. 1003567-83-6), OMNIPOL TX (polybutylene glycol bis(9-oxo-9H-thioxanthenyloxy)

acetate, CAS No. 813452-37-8), and OMNIPOL BP (polybutylene glycol bis(4-benzoylphenoxy)acetate, CAS No. 515136-48-8). The radical polymerization initiator having a weight-average molecular weight of 500 to 3,000 as a molecular weight is preferably 0.01 to 10 mass % of the entire undercoat composition, more preferably 0.05 to 8.0 mass %, yet more preferably 0.1 to 5.0 mass %, and particularly preferably 0.1 to 2.4 mass %. Within this range, the curability is excellent.

From the viewpoint of suppression of migration, odor, and blocking, the content of the radical polymerization initiator having a molecular weight of less than 340 in the undercoat composition is preferably either zero or greater than 0 mass % but no greater than 1.0 mass % of the entire undercoat composition, more preferably zero or greater than 0 mass % but no greater than 0.5 mass %, yet more preferably zero or greater than 0 mass % but no greater than 0.3 mass %, and particularly preferably zero.

The undercoat composition preferably comprise, as a radical polymerization initiator, a compound which functions as a sensitizer (hereinafter also calls 'sensitizer') in order to promote decomposition of the radical polymerization initiator by absorbing specific actinic radiation.

Examples of the sensitizer include polynuclear aromatic compounds (e.g. pyrene, perylene, triphenylene, 2-ethyl-9, 10-dimethoxy anthracene), xanthenes (e.g. fluorescein, eosin, erythrosine, rhodamine B, rose bengal), cyanines (e.g. thiacarbocyanine, oxacarbocyanine), merocyanines (e.g. merocyanine, carbomerocyanine), thiazines (e.g. thionine, methylene blue, toluidine blue), acridines (e.g. acridine orange, chloroflavin, acriflavine), anthraquinones (e.g. anthraquinone), squaryliums (e.g. squarylium), and coumarins (e.g. 7-diethylamino-4-methylcoumarin), thioxanthones (e.g. isopropylthioxanthone), and thiochromanones (e.g. thiochromanone).

Among them, as a sensitizer, a thioxanthones is preferable, and isopropylthioxanthone is more preferable.

The sensitizer may be used singly or in a combination of two or more compounds.

In the undercoat composition, the total content of the polymerization initiator is preferably 1.0 to 15.0 mass % relative to the mass of the entire ink composition, more preferably 1.5 to 10.0 mass %, and yet more preferably 2.0 to 8.0 mass %. When in the above-mentioned range, the ink composition having excellent curability is obtained.

<Polyol Compound>

The undercoat composition used in the present invention may comprise a polyol compound.

The polyol compound is preferably a diol compound.

The polyol compound is not particularly limited, but a commercial product available in a two-component adhesive comprising an isocyanate compound and a polyol compound can be used, such as CAT-RT-37-2K (Toyo-Morton, Ltd.) where the isocyanate compound is TM-550, or an X series solvent-free adhesive such as XA126-1 (Dainichiseika Color & Chemicals Mfg. Co., Ltd.) where the isocyanate compound is XC233-2.

When the undercoat composition used in the present invention comprises a polyol compound, the content of the polyol compound relative to the total mass of the undercoat composition is preferably 5 to 50 mass %, and more preferably 10 to 40 mass %.

<Colorant>

The undercoat composition that can be used in the present invention may comprise a colorant, preferably comprises a white colorant or does not comprise one, and more preferably does not comprise one.

As the white pigment, Pigment White 6, 18, 21, etc. may be used according to the intended application.

Furthermore, when the undercoat composition comprises a colorant, the content of the colorant in the composition is selected appropriately according to the color and the intended application, but is preferably 0.01 to 30 mass % relative to the mass of the entire undercoat solution.

<Dispersant>

The undercoat composition that can be used in the present invention may comprise a dispersant. Especially, when the colorant is used, the undercoat composition preferably comprises a dispersant in order to stably disperse the colorant in the undercoat composition.

As the dispersant, a polymeric dispersant is preferable. The 'polymeric dispersant' referred to in the present invention means a dispersant having a weight-average molecular weight of 1,000 or greater.

Examples of the polymeric dispersant include polymeric dispersants such as DISPERBYK-101, DISPERBYK-102, DISPERBYK-103, DISPERBYK-106, DISPERBYK-111, DISPERBYK-161, DISPERBYK-162, DISPERBYK-163, DISPERBYK-164, DISPERBYK-166, DISPERBYK-167, DISPERBYK-168, DISPERBYK-170, DISPERBYK-171, DISPERBYK-174, and DISPERBYK-182 (manufactured by BYK Chemie), EFKA4010, EFKA4046, EFKA4080, EFKA5010, EFKA5207, EFKA5244, EFKA6745, EFKA6750, EFKA7414, EFKA745, EFKA7462, EFKA7500, EFKA7570, EFKA7575, and EFKA7580 (manufactured by EFKA Additives), Disperse Aid 6, Disperse Aid 8, Disperse Aid 15, and Disperse Aid 9100 (manufactured by San Nopco Limited); various types of SOLSPERSE dispersants such as Solsperse 3000, 5000, 9000, 12000, 13240, 13940, 17000, 22000, 24000, 26000, 28000, 32000, 36000, 39000, 41000, and 71000 (manufactured by Noveon); Adeka Pluronic L31, F38, L42, L44, L61, L64, F68, L72, P95, F77, P84, F87, P94, L101, P103, F108, L121, and P-123 (manufactured by Adeka Corporation), Ionet S-20 (manufactured by Sanyo Chemical Industries, Ltd.), and Disparlon KS-860, 873SN, and 874 (polymeric dispersant), #2150 (aliphatic poly carboxylic acid), and #7004 (polyether ester type) (manufactured by Kusumoto Chemicals, Ltd.).

The content of the dispersant in the undercoat composition is appropriately selected according to the intended purpose, and is preferably 0.05 to 15 mass % relative to the mass of the entire undercoat composition.

<Surfactant>

The undercoat composition of the present invention may comprise a surfactant in order to provide stable discharge properties for a long period of time.

As the surfactant, those described in JP-A-62-173463 and JP-A-62-183457 can be cited. Examples thereof include anionic surfactants such as dialkylsulfosuccinic acid salts, alkylnaphthalene sulfonic acid salts, and fatty acid salts; nonionic surfactants such as polyoxyethylene alkyl ethers, polyoxyethylene alkyl aryl ethers, acetylene glycols and polyoxyethylene/polyoxypropylene block copolymers; and cationic surfactants such as alkylamine salts and quaternary ammonium salts. A fluorine-based surfactant (e.g. an organofluoro compound) or a silicone-based surfactant (e.g. a polysiloxane compound) may be used as the above-mentioned surfactant. The organofluoro compound is preferably hydrophobic. Examples of the organofluoro compound include fluorine-based surfactants, oil-like fluorine-based compounds (e.g. fluorine oils), solid fluorine compound resins (e.g. tetrafluoroethylene resin), and those described in JP-B-57-9053 (columns 8 to 17) and JP-A-62-135826.

The polysiloxane compound is preferably a modified polysiloxane compound where an organic group is introduced into a part of a methyl group of dimethyl polysiloxane. Examples of the modification include polyether modification, methyl styrene modification, alcohol modification, alkyl modification, aralkyl modification, fatty acid ester modification, epoxy modification, amine modification, amino modification, mercapto modification, and the like, but the modification is not particularly limited to the above. The methods of modification may be used in combination. Among them, the polyether-modified polysiloxane compounds are preferable from the viewpoint of improving inkjet discharge stability.

Examples of the polyether-modified polysiloxane compound include SILWET L-7604, SILWET L-7607N, SILWET FZ-2104, SILWET FZ-2161 (manufactured by Nippon Unicar Co., Ltd.), BYK306, BYK307, BYK331, BYK333, BYK347, BYK348, and the like (manufactured by BYK Chemie Co., Ltd.), KF-351A, KF-352A, KF-353, KF-354L, KF-355A, KF-615A, KF-945, KF-640, KF-642, KF-643, KF-6020, X-22-6191, X-22-4515, KF-6011, KF-6012, KF-6015, and KF-6017 (manufactured by Shin-Etsu Chemical Co., Ltd.).

Among them, as the surfactant, a silicone-type surfactant is preferable.

The content of the surfactant in the undercoat composition or the ink composition of the present invention is appropriately adjusted according to the intended application, and is preferably 0.0001 to 5 mass % relative to the entire mass of the undercoat composition or the ink composition, and more preferably 0.001 to 2 mass %.

<Other Components>

The undercoat composition or the ink composition that can be used in the present invention may comprise as necessary, in addition to the above-mentioned components, a co-sensitizer, a UV absorber, an antioxidant, an antifading agent, a conductive salt, a solvent, a polymer compound, a basic compound, etc. They are described in JP-A-2009-221416 and may be used as well.

Furthermore, from the viewpoint of storage properties and suppression of head clogging, the undercoat composition may comprise a polymerization inhibitor.

The polymerization inhibitor is preferably added at 200 to 20,000 ppm relative to the total amount of the undercoat composition.

Examples of the polymerization inhibitor include a nitroso-based polymerization inhibitor, a hindered amine-based polymerization inhibitor, hydroquinone, benzoquinone, p-methoxyphenol, TEMPO, TEMPOL, and Al cupferron.

<Properties of Undercoat Composition>

In the present invention, when the undercoat layer is applied by an inkjet method, the undercoat composition has a viscosity at 25° C. of preferably no more than 40 mPa·s, more preferably 5 to 40 mPa·s, and yet more preferably 7 to 30 mPa·s. Furthermore, the viscosity of the undercoat composition at the discharge temperature (preferably 25° C. to 80° C., and more preferably 25° C. to 50° C.) is preferably 3 to 15 mPa·s, and more preferably 3 to 13 mPa·s. With regard to the undercoat composition of the present invention, it is preferable that its component ratio is appropriately adjusted so that the viscosity is in the above-mentioned range. When the viscosity at room temperature (25° C.) is set to be high, even when a porous recording medium (support) is used, penetration of the ink composition into the recording medium can be prevented, and uncured monomer can be reduced.

The viscosity of the undercoat composition is measured using a model E viscometer (Toki Sangyo Co., Ltd.).

The surface tension of the undercoat composition of the present invention at 25° C. is preferably 15 to 40 mN/m, more preferably 20 to 35 mN/m, and yet more preferably 20 to 30 mN/m.

As a method for measuring surface tension at 25° C. of the undercoat composition, a known method may be used, but it is preferable to carry out measurement by a suspended ring method or the Wilhelmy method. Preferred examples include a method using a CBVP-Z automated surface tensiometer manufactured by Kyowa Interface Science Co., Ltd. and a method using a SIGMA 702 manufactured by KSV INSTRUMENTS LTD.

<Preparation of Undercoat Composition>

With regard to a method of preparing the undercoat composition of the present invention, it may be prepared by stirring and mixing the respective components.

In addition, the temperature and the humidity during the preparation is preferably in a range of 5° C. to 30° C. and 5 to 65%.

Here, when preparing an undercoat solution, all components to be contained in the undercoat solution may be stirred and mixed at the same time, or a solution obtained by stirring and mixing components other than the isocyanate compound and/or the radical polymerization initiator may be stored, and the isocyanate compound and/or the radical polymerization initiator may be added thereto prior to use, thus preparing an undercoat solution.

In step a of the inkjet recording method of the present invention, it is preferable from the viewpoint of coating properties that the undercoat composition is applied to a recording medium within one day after preparation. The storing condition is preferably under temperature of 0° C. to 30° C. and humidity of 0 to 70%.

The undercoat composition of the present invention preferably comprises the isocyanate compound at a content of 2 to 90 mass %, the radically polymerizable monomer at a content of 10 to 80 mass %, and the radically polymerizable monomer at a content of 0.01 to 10 mass %, relative to the total mass of the undercoat composition.

(Ink Composition)

The ink composition used in the inkjet recording method of the present invention comprises a radically polymerizable monomer, a radical polymerization initiator, and a colorant.

From the viewpoint of curability, the total content of radically polymerizable monomer in the ink composition is preferably 70 to 98 mass % of the entire composition, more preferably 70 to 95 mass %, and yet more preferably 80 to 93 mass %.

Furthermore, the content of polyfunctional ethylenically unsaturated compound in the ink composition is preferably at least 70 mass % relative to the total content of the radically polymerizable monomer, more preferably 70 to 100 mass %, and yet more preferably 80 to 100 mass %.

Moreover, in the inkjet recording method of the present invention it is preferable that the content of the polyfunctional monomer in the undercoat composition is at least 70 mass % relative to the total content of the radically polymerizable monomer and the content of the polyfunctional monomer in the ink composition is at least 70 mass % relative to the total content of the radically polymerizable monomer, and it is more preferable that the content of the polyfunctional monomer in the undercoat composition is at least 80 to 100 mass % relative to the total content of radically polymerizable monomer and the content of the polyfunctional monomer in the ink composition is 80 to 100 mass % relative to the total content of the radically polymerizable monomer.

In accordance with a combination of the undercoat composition and the ink composition described above, the odor of a printed material can be suppressed.

In addition, the radically polymerizable monomer and the radical polymerization initiator have the same meanings as those of the radically polymerizable monomer and the radical polymerization initiator in the undercoat composition, and preferred embodiments are also the same.

In the inkjet recording method of the present invention, the ink composition and the undercoat composition preferably comprise an acylphosphine compound as the radical polymerization initiator.

Furthermore, it is preferable for a polyalkylene glycol diacrylate to be contained as a polyfunctional ethylenically unsaturated compound (more preferably a polyfunctional ethylenically unsaturated monomer). The polyalkylene glycol diacrylate is preferably polyethylene glycol diacrylate or polypropylene glycol diacrylate.

Moreover, the repeat number of alkylene glycol units, that is, of alkylene oxy groups, in the polyalkylene glycol diacrylate is at least 2, preferably 2 to 100, and more preferably 2 to 20.

The undercoat composition and the ink composition preferably each comprise a difunctional (meth)acrylate compound.

Furthermore, in the present invention, the ink composition is a radiation-curable ink composition and is different from an aqueous ink composition or a solvent ink composition. The water and volatile solvent content of the ink composition is preferably as little as possible, and even if they are contained, they are preferably no greater than 1 mass % relative to the total mass of the ink composition, more preferably no greater than 0.5 mass %, and yet more preferably no greater than 0.1 mass %.

<Colorant>

The ink composition that can be used in the present invention comprises a colorant in order to improve the visibility of a formed image area.

The colorant is not particularly limited, but a pigment and an oil-soluble dye that have excellent weather resistance and rich color reproduction are preferable, and it may be selected from any known coloring agent such as a soluble dye. It is preferable that the colorant does not function as a polymerization inhibitor in a polymerization reaction, which is a curing reaction. This is because the sensitivity of the curing reaction by actinic radiation should not be degraded.

The pigment that can be used in the present invention is not particularly limited and, for example, organic and inorganic pigments having the numbers below described in the Color Index may be used.

That is, as a red or magenta pigment, Pigment Red 3, 5, 19, 22, 31, 38, 42, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, or 257, Pigment Violet 3, 19, 23, 29, 30, 37, 50, or 88, and Pigment Orange 13, 16, 20, or 36; as a blue or cyan pigment, Pigment Blue 1, 15, 15:1, 15:2, 15:3, 15:4, 15:6, 16, 17-1, 22, 27, 28, 29, 36, or 60; as a green pigment, Pigment Green 7, 26, 36, or 50; as a yellow pigment, Pigment Yellow 1, 3, 12, 13, 14, 17, 34, 35, 37, 55, 74, 81, 83, 93, 94, 95, 97, 108, 109, 110, 120, 137, 138, 139, 153, 154, 155, 157, 166, 167, 168, 180, 185, or 193; as a black pigment, Pigment Black 7, 28, or 26; as a white pigment, Pigment White 6, 18, or 21, etc. may be used according to the intended application.

In the present invention, a disperse dye may be used in a range that enables it to be dissolved in a water-immiscible organic solvent. Disperse dyes generally include water-soluble dyes, but in the present invention it is preferable for the disperse dye to be used in a range such that it dissolves in a water-immiscible organic solvent.

Specific preferred examples of the disperse dye include CI Disperse Yellow 5, 42, 54, 64, 79, 82, 83, 93, 99, 100, 119, 122, 124, 126, 160, 184:1, 186, 198, 199, 201, 204, 224, and 237; CI Disperse Orange 13, 29, 31:1, 33, 49, 54, 55, 66, 73, 118, 119, and 163; CI Disperse Red 54, 60, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 311, 323, 343, 348, 356, and 362; CI Disperse Violet 33; CI Disperse Blue 56, 60, 73, 87, 113, 128, 143, 148, 154, 158, 165, 165:1, 165:2, 176, 183, 185, 197, 198, 201, 214, 224, 225, 257, 266, 267, 287, 354, 358, 365, and 368; and CI Disperse Green 6:1 and 9.

It is preferable that the colorant is added to the ink composition and then dispersed in the ink to an appropriate degree. For dispersion of the colorant, for example, a dispersing machine such as a ball mill, a sand mill, an attritor, a roll mill, an agitator, a Henschel mixer, a colloidal mill, an ultrasonic homogenizer, a pearl mill, a wet type jet mill, or a paint shaker may be used.

The colorant may be added directly to the ink composition, but in order to improve dispersibility it may be added in advance to a solvent or a dispersing medium such as a polymerizable compound used in the present invention.

In the present invention, in order to avoid the problem of the solvent resistance being degraded when the solvent remains in the cured image and the VOC (Volatile Organic Compound) problem of the residual solvent, it is preferable to add the colorant in advance to a dispersing medium such as a polymerizable compound. As a polymerizable compound used, it is preferable in terms of dispersion suitability to select a monomer having low viscosity. The colorants may be used by appropriately selecting one type or two or more types according to the intended purpose of the ink composition.

When a colorant such as a pigment that is present as a solid in the ink composition is used, it is preferable for the colorant, the dispersant, the dispersing medium, dispersion conditions, and filtration conditions to be set so that the average particle size of colorant particles is preferably 0.005 to 0.5 μm, more preferably 0.01 to 0.45 μm, and yet more preferably 0.015 to 0.4 μm. By such control of particle size, clogging of a head nozzle can be suppressed, and the ink storage stability, the transparency, and the curing sensitivity can be maintained.

The content of the colorant in the ink composition is appropriately selected according to the color and the intended purpose, and is preferably 0.01 to 30 mass % relative to the mass of the entire ink composition.

The content of the colorant in the undercoat composition is appropriately selected according to the color and the intended purpose, and is preferably 0.01 to 30 mass % relative to the mass of the entire undercoat composition.

<Other Components>

The ink composition that can be used in the present invention may comprise a dispersant, a surfactant and other components.

The dispersant, the surfactant and the other components in the ink composition has the same meaning as that of the dispersant, the surfactant and the other components in the undercoat composition above, and preferred embodiments are also the same.

<Properties of Ink Composition>

While taking into consideration dischargeability, the ink composition of the present invention has a viscosity at 25° C. of preferably no more than 40 mPa·s, more preferably 5 to 40 mPa·s, and yet more preferably 7 to 30 mPa·s. Furthermore, the viscosity of the ink composition at the discharge temperature (preferably 25° C. to 80° C., and more preferably 25° C. to 50° C.) is preferably 3 to 15 mPa·s, and more preferably 3 to 13 mPa·s. With regard to the ink composition of the present invention, it is preferable that its component ratio is appropriately adjusted so that the viscosity is in the above-mentioned range. When the viscosity at room temperature (25° C.) is set to be high, even when a porous recording medium (support) is used, penetration of the ink composition into the recording medium can be prevented, and uncured monomer can be reduced. Furthermore, ink spreading when droplets of ink composition have landed can be suppressed, and as a result there is the advantage that the image quality is improved.

The surface tension of the ink composition of the present invention at 25° C. is preferably 20 to 40 mN/m, more preferably 20.5 to 35.0 mN/m, yet more preferably 21 to 30.0 mN/m, and particularly preferable 21.5 to 28.0 mN/m. When in the above range, a printed material having excellent blocking resistance is obtained.

The ink composition of the present invention preferably comprises the radically polymerizable monomer at a content of 70 to 98 mass %, the radically polymerizable monomer at a content of 0.01 to 10 mass % and the colorant at a content of 0.01 to 30 mass % relative to the total mass of the undercoat composition.

(Set for Preparing Undercoat Composition and Set for Inkjet Recording)

The undercoat composition used in the present invention may also be provided as a set for preparing an undercoat composition.

The set of preparing an undercoat composition preferably comprises an isocyanate compound-containing composition A and/or an isocyanate compound, a radically polymerizable monomer-containing composition B and/or a radically polymerizable monomer, and a radical polymerization initiator-containing composition C and/or a radical polymerization initiator.

Due to the above compound and/or composition being mixed, the undercoat composition used in the present invention can be prepared.

Composition B and composition C may be composition B' comprising a radically polymerizable monomer and a radical polymerization initiator.

The isocyanate compound, the radically polymerizable monomer, and the radical polymerization initiator have the same meanings as those of the isocyanate compound, the radically polymerizable monomer, and the radical polymerization initiator used in the undercoat composition, and preferred embodiments are also the same.

Compositions A to C above may comprise another component that is described above as being contained in the undercoat composition, but from the viewpoint of storage stability, composition A preferably does not comprise a polyol compound, and composition A is more preferably a composition comprising an isocyanate compound and a solvent.

Furthermore, the set for preparing an undercoat composition may further comprise composition D comprising another component that is described above as being contained in the undercoat composition.

Moreover, the undercoat composition and the ink composition used in the present invention may be provided as a set for inkjet recording.

For example, the set for inkjet recording may comprise one or more ink compositions used in the present invention in addition to the set for preparing the undercoat composition.

Examples

The present invention is explained below more specifically by way of Examples and Comparative Examples. However, the present invention should not be construed as being limited by these Examples.

'Parts' below means 'parts by mass' unless otherwise specified.

Furthermore, the Examples and Comparative Examples below were carried out under conditions of a temperature of about 25° C. and a humidity of about 50%.

Examples

The materials used in the present invention were as follows.

<Colorants>

IRGALITE BLUE GLVO (cyan pigment, BASF Japan)

CINQUASIA MAGENTA RT-355-D (magenta pigment, BASF Japan)

NOVOPERM YELLOW H2G (yellow pigment, Clariant)

SPECIAL BLACK 250 (black pigment, BASF Japan)

Tipaque CR60-2 (white pigment, Ishihara Sangyo Kaisha Ltd.)

<Dispersant>

SOLSPERSE 32000 (dispersant, Noveon)

<Radically Polymerizable Monomers>

SR9003: propoxylated (2) neopentyl glycol diacrylate (Sartomer)

SR341: 3-methyl-1,5-pentanediol diacrylate (Sartomer)

SR489D: tridecyl acrylate (Sartomer)

DVE-3: triethylene glycol divinyl ether (BASF)

SR344: polyethylene glycol (400) diacrylate (Sartomer)

<Binder Polymer>

DIANAL BR113 (acrylic resin, Dianal America)

<Radical Polymerization Initiators>

IRGACURE 819 (bis(2,4,6-trimethylbenzoyl)phenylphosphine oxide, molecular weight 419, BASF)

Speedcure 7010 (molecular weight 1,899, Lambson)

<Isocyanate Compounds>

TM-550 (NCO type urethane ester resin, Toyo-Morton, Ltd.)

XC233-2 (terminal NCO type polyether urethane resin, Dainichiseika Color & Chemicals Mfg. Co., Ltd.)

Takenate D103H (adduct between tolylene diisocyanate and trimethylolpropane, Mitsui Chemicals Polyurethanes, Inc.)

Takenate D204 (isocyanurate of tolylene diisocyanate, Mitsui Chemicals Polyurethanes, Inc.)

Takenate D160N (adduct between hexamethylene diisocyanate and trimethylolpropane, Mitsui Chemicals Polyurethanes, Inc.)

Takenate D170N (isocyanurate of hexamethylene diisocyanate, Mitsui Chemicals Polyurethanes, Inc.)

Takenate D165N (biuret of hexamethylene diisocyanate, Mitsui Chemicals Polyurethanes, Inc.)

Takenate D178NL (allophanate of hexamethylene diisocyanate, Mitsui Chemicals Polyurethanes, Inc.)

Takenate D110N (adduct between xylylene diisocyanate and trimethylolpropane, Mitsui Chemicals Polyurethanes, Inc.)

<Polyol Compounds>

CAT-RT-37-2K (Toyo-Morton, Ltd.)

XA126-1 (Dainichiseika Color & Chemicals Mfg. Co., Ltd.)

<Polymerization Inhibitor>

UV-22 (Irgastab (registered trademark) UV-22, Poly[oxy(methyl-1,2-ethanediyl)],α,α',α"-1,2,3-propanetriyltris[ω-[(1-oxo-2-propen-1-yl)oxy]-,2,6-bis(1,1-dimethylethyl)-4-(phenylenemethylene)cyclohexa-2,5-dien-1-one, BASF)

<Surfactant>

BYK-307 (silicone-based surfactant (polyether-modified polydimethylsiloxane), BYK Chemie)

(Preparation of Mill Bases)

<Preparation of Cyan Mill Base A>

300 parts by mass of IRGALITE BLUE GLVO, 620 parts by mass of SR9003, and 80 parts by mass of SOLSPERSE 32000 were mixed by stirring, thus giving cyan mill base A. Preparation of cyan mill base A was carried out by dispersing using a Motor Mill M50 disperser (Eiger Machinery, Inc.) with zirconia beads having a diameter of 0.65 mm at a peripheral speed of 9 m/s for 4 hours.

<Preparation of Magenta Mill Base B, Yellow Mill Base C, Black Mill Base D, and White Mill Base E>

Magenta mill base B, yellow mill base C, black mill base D, and white mill base E were prepared in the same manner as for cyan mill base A using the formulations and dispersion conditions shown in Table 1.

TABLE 1

| | Mill base | Cyan mill base A | Magenta mill base B | Yellow mill base C | Black mill base D | White mill base E |
|---|---|---|---|---|---|---|
| Composition (parts) | IRGALITE BLUE GLVO | 300 | — | — | — | — |
| | CINQUASIA MAGENTA RT-355-D | — | 300 | — | — | — |
| | NOVOPERM YELLOW H2G | — | — | 300 | — | — |
| | SPECIAL BLACK 250 | — | — | — | 400 | — |
| | Tipaque CR60-2 | — | — | — | — | 500 |
| | SR9003 | 620 | 600 | 600 | 520 | 440 |
| | SOLSPERSE 32000 | 80 | 100 | 100 | 80 | 60 |
| Dispersion conditions | Peripheral speed (m/s) | 9 | 9 | 9 | 9 | 9 |
| | Time (hours) | 4 | 10 | 10 | 7 | 4 |

<Preparation of Undercoat Composition and Ink Composition>

Materials were stirred and mixed using a mixer (Silverson L4R) at room temperature (25° C.) and 5,000 rpm for 20 minutes at ratios shown in Table 2 and Table 3, thus preparing the undercoat compositions and the ink compositions used in Examples 1 to 18 and Comparative Examples 1 to 3. Furthermore, the undercoat composition used in Comparative Example 2 was stored at room temperature for one day before use in an experiment. The units of the contents of the components in Table 2 and Table 3 are parts by mass. Moreover, the notation '-' in the table means that the component is not present. In the tables, the notation '2.4<' means that the peel-off force exceeds 2.4 N/cm.

<Image Formation Method>

As shown in FIG. 1, a roller applicator (amount of undercoat solution applied; 2 μm) was disposed in the most upstream section of a roll transport system, and on the downstream thereof were disposed an LED light source, a head for black, an LED light source, a head for cyan, an LED light source, a head for magenta, an LED light source, a head for W, and a nitrogen-purged LED exposure unit.

As inkjet heads four CA3 heads manufactured by Toshiba Tec Corporation were arranged side by side for each color, the heads were heated to 45° C., and the frequency was controlled so that drawing could be carried out with a fired droplet size of 42 pL. As an LED light source, an LED light source unit having a peak wavelength at 385 nm (LEDZero Solidcure, Integration Technology) was used. With regard to nitrogen purging, as an inert gas source a Maxi-Flow30 $N_2$ gas generating device (Inhouse Gas) equipped with a compressor was connected at a pressure of 0.2 MPa·s, and the nitrogen concentration was set by making nitrogen flow at a flow rate of 2 to 10 L/min so that the nitrogen concentration within the blanket was 99% and the oxygen concentration was 1%. As a recording medium, OPP (stretched polypropylene) having a thickness of 25 μm, PET (polyethylene terephthalate) having a thickness of 12 μm, and nylon having a thickness of 15 μm were used.

Scanning was carried out at a speed of 30 m/min, and the recording medium coated with undercoat solution was semi-cured using the LED light source (exposure intensity for semi-curing 40 W/cm$^2$). The ink compositions were discharged thereonto, and the ink compositions were semi-cured using the LED light sources (exposure intensity for semi-curing 40 W/cm$^2$), thus drawing a 100% solid image. Subsequently, the image was completely cured by means of the LED light source. Various aspects of performance shown below were tested.

The light intensity of the LED light sources prior to the nitrogen-purged exposure was adjusted so that the undercoat solution and the ink composition could be maintained in the semi-cured state.

Being 'completely cured' in the present invention means a state in which the interior and surface of the undercoat solution and ink composition on the recording medium are completely cured. Specifically, it can be evaluated by pressing plain paper (e.g. copier paper C2, product code V436, Fuji Xerox Co., Ltd.) with a uniform force (a constant value in the range of 500 to 1,000 mN/cm$^2$), and examining liquid surface transfer to the plain paper. That is, when there is no transfer at all, it is defined as being in a completely cured state.

<Method for Measuring Adhesion>

1 cm wide Sellotape (registered trademark) was affixed to an image face of an image sample obtained by the image formation method using PET as a recording medium, and the peel-off force (force required to start peel off: N/cm, peel-off speed: 300 mm/min) between the recording medium and the undercoat layer was measured using a ZTS series standard digital force gauge manufactured by IMADA, an MX2 series vertical motorized test stand, and a P90-200N/200N-EZ 90° peel-off test jig with an FC series film chuck.

The larger the peel-off force, the better the adhesion. When the peel-off force was evaluated in the same manner as for PET except that an OPP film was used as the recording medium and the ink of Example 1 was used, the same adhesion evaluation as for PET was obtained.

<Odor Evaluation>

An image sample (A4 size solid image) obtained by the image formation method was placed inside a 30 cm×30 cm zippered vinyl bag and allowed to stand for 24 hours. Subsequently, the zip was opened, and the odor was evaluated. The average evaluation of 10 people was employed. The average value was rounded off after the decimal point. When the evaluation was 3 or greater, there was no problem in practice.

1: very strong odor
2: strong odor
3: some odor but not unpleasant
4: slight odor but almost unnoticeable
5: substantially no odor <Blocking Evaluation>

In the image formation method, PET was superimposed on a completely cured undercoated PET substrate without discharging the ink composition, a weight of 1 kg was placed thereon for 1 minute, and the state when the superimposed PET was peeled off was evaluated. Furthermore, in the case of an OPP substrate, OPP was superimposed, a weight of 1 kg was placed thereon for 1 minute, and the state when the superimposed OPP was peeled off was evaluated.

4: there was no transferred material on either the peeled off PET or the peeled off OPP, and there was no sound when peeling off.

3: there was no transferred material on either the peeled off PET or the peeled off OPP, and there was no sound when peeling off the OPP, but there was a sound when peeling off the PET.

2: there was no transferred material on the peeled off OPP, and there was no sound when peeling off, but there was transferred material on the peeled off PET.

1: there was transferred material on both the peeled off PET and the peeled off OPP.

TABLE 2

| | | | Example | | | | | | | | | |
|---|---|---|---|---|---|---|---|---|---|---|---|---|
| | | | 1 | 2 | 3 | 4 | 5 | 6 | 7 | 8 | 9 | 10 |
| Ink | Radically polymerizable monomer | SR341 | 74.1 | 74.1 | 74.1 | 74.1 | 74.1 | 74.1 | 74.1 | 74.1 | 74.1 | 74.1 |
| | | SR489D | — | — | — | — | — | — | — | — | — | — |
| | | DVE-3 | — | — | — | — | — | — | — | — | — | — |
| | | SR344 | 10 | 10 | 10 | 10 | 10 | 10 | 10 | 10 | 10 | 10 |
| | Radical polymerization initiator | IRGACURE 819 (Mw: 419) | 4 | 4 | 4 | 4 | 4 | 4 | 4 | 4 | 4 | 4 |
| | | Speedcure 7010 (Mw: 1899) | 2 | 2 | 2 | 2 | 2 | 2 | 2 | 2 | 2 | 2 |
| | Mill base | Cyan mill base A | 9.5 | 9.5 | 9.5 | 9.5 | 9.5 | 9.5 | 9.5 | 9.5 | 9.5 | 9.5 |
| | | Magenta mill base B | — | — | — | — | — | — | — | — | — | — |
| | | Yellow mill base C | — | — | — | — | — | — | — | — | — | — |
| | | Black mill base D | — | — | — | — | — | — | — | — | — | — |
| | | White mill base E | — | — | — | — | — | — | — | — | — | — |
| | Polymerization inhibitor | UV-22 | 0.26 | 0.26 | 0.26 | 0.26 | 0.26 | 0.26 | 0.26 | 0.26 | 0.26 | 0.26 |
| | Surfactant | BYK307 | 0.1 | 0.1 | 0.1 | 0.1 | 0.1 | 0.1 | 0.1 | 0.1 | 0.1 | 0.1 |
| | | Total | 100 | 100 | 100 | 100 | 100 | 100 | 100 | 100 | 100 | 100 |
| Under coat | Isocyanate compound | TM550 | 36.8 | — | — | — | — | — | — | — | — | 50 |
| | | XC233-2 | — | 50.2 | — | — | — | — | — | — | — | — |
| | | Takenate D103H | — | — | 70 | — | — | — | — | — | — | — |
| | | Takenate D204 | — | — | — | 70 | — | — | — | — | — | — |
| | | Takenate D160N | — | — | — | — | 70 | — | — | — | — | — |
| | | Takenate D170N | — | — | — | — | — | 70 | — | — | — | — |
| | | Takenate D165N | — | — | — | — | — | — | 70 | — | — | — |
| | | Takenate D178NL | — | — | — | — | — | — | — | 70 | — | — |
| | | Takenate D110N | — | — | — | — | — | — | — | — | 70 | — |
| | Polyol compound | CAT-RT-37-2K | 33.2 | — | — | — | — | — | — | — | — | 20 |
| | | XA126-1 | — | 19.8 | — | — | — | — | — | — | — | — |
| | Radically polymerizable monomer | SR341 | 25 | 25 | 25 | 25 | 25 | 25 | 25 | 25 | 25 | 25 |
| | Binder polymer | DIANAL BR 113 | — | — | — | — | — | — | — | — | — | — |
| | Radical polymerization initiator | IRGACURE 819 (Mw: 419) | 4 | 4 | 4 | 4 | 4 | 4 | 4 | 4 | 4 | 4 |
| | Surfactant | BYK307 | 1 | 1 | 1 | 1 | 1 | 1 | 1 | 1 | 1 | 1 |
| | | Total | 100 | 100 | 100 | 100 | 100 | 100 | 100 | 100 | 100 | 100 |
| | Coating | | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. |
| Performance result | Peel-off force (N/cm) | | 1.2 | 0.3 | 2.4< | 2.4< | 2.4< | 2.4< | 2.4< | 2.4< | 2.4< | 0.8 |
| | Odor | | 5 | 5 | 5 | 5 | 5 | 5 | 5 | 5 | 5 | 5 |
| | Blocking | | 2 | 2 | 2 | 2 | 2 | 2 | 2 | 2 | 2 | 2 |

TABLE 3

| | | | Example | | | | | | | | Comparative Example | | |
|---|---|---|---|---|---|---|---|---|---|---|---|---|---|
| | | | 11 | 12 | 13 | 14 | 15 | 16 | 17 | 18 | 1 | 2 | 3 |
| Ink | Radically polymerizable monomer | SR341 | 54.1 | 64.1 | 74.1 | 74.1 | 75.6 | 68.1 | 72.6 | 58.6 | 74.1 | 74.1 | 74.1 |
| | | SR489D | 20 | — | — | — | — | — | — | — | — | — | — |
| | | DVE-3 | — | 10 | — | — | — | — | — | — | — | — | — |
| | | SR344 | 10 | 10 | 10 | 10 | 2 | 15 | 15 | 5 | 10 | 10 | 10 |
| | Radical polymerization initiator | IRGACURE 819 (Mw: 419) | 4 | 4 | 4 | 4 | 4 | 4 | 4 | 4 | 4 | 4 | 4 |
| | | Speedcure 7010 (Mw: 1899) | 2 | 2 | 2 | 2 | 2 | 2 | 2 | 2 | 2 | 2 | 2 |
| | Mill base | Cyan mill base A | 9.5 | 9.5 | 9.5 | 9.5 | — | — | — | — | 9.5 | 9.5 | 9.5 |
| | | Magenta mill base B | — | — | — | — | 16 | — | — | — | — | — | — |
| | | Yellow mill base C | — | — | — | — | — | 10.5 | — | — | — | — | — |
| | | Black mill base D | — | — | — | — | — | — | 6 | — | — | — | — |
| | | White mill base E | — | — | — | — | — | — | — | 30 | — | — | — |
| | Polymerization inhibitor | UV-22 | 0.26 | 0.26 | 0.26 | 0.26 | 0.26 | 0.26 | 0.26 | 0.26 | 0.26 | 0.26 | 0.26 |
| | Surfactant | BYK307 | 0.1 | 0.1 | 0.1 | 0.1 | 0.1 | 0.1 | 0.1 | 0.1 | 0.1 | 0.1 | 0.1 |
| | | Total | 100 | 100 | 100 | 100 | 100 | 100 | 100 | 100 | 100 | 100 | 100 |
| Undercoat | Isocyanate compound | TM550 | — | — | — | — | — | — | — | — | — | — | — |
| | | XC233-2 | — | — | — | — | — | — | — | — | — | 71 | 71 |
| | | Takenate D103H | — | — | — | — | — | — | — | — | — | — | — |
| | | Takenate D204 | — | — | — | — | — | — | — | — | — | — | — |
| | | Takenate D160N | — | — | — | — | — | — | — | — | — | — | — |
| | | Takenate D170N | 70 | 70 | 20 | 15 | 70 | 70 | 70 | 70 | — | — | — |
| | | Takenate D165N | — | — | — | — | — | — | — | — | — | — | — |
| | | Takenate D178NL | — | — | — | — | — | — | — | — | — | — | — |
| | | Takenate D110N | — | — | — | — | — | — | — | — | — | — | — |
| | Polyol compound | CAT-RT-37-2K | — | — | — | — | — | — | — | — | — | — | — |
| | | XA126-1 | — | — | — | — | — | — | — | — | — | 28 | 28 |
| | Radically polymerizable monomer | SR341 | 25 | 25 | 75 | 71 | 26 | 26 | 26 | 26 | 96 | — | — |
| | Binder polymer | DIANAL BR 113 | — | — | — | 9 | — | — | — | — | — | — | — |
| | Radical polymerization initiator | IRGACURE 819 (Mw: 419) | 4 | 4 | 4 | 4 | 3 | 3 | 3 | 3 | 3 | — | — |
| | Surfactant | BYK307 | 1 | 1 | 1 | 1 | 1 | 1 | 1 | 1 | 1 | 1 | 1 |
| | | Total | 100 | 100 | 100 | 100 | 100 | 100 | 100 | 100 | 100 | 100 | 100 |
| | Coating | | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | Imm. after soln. prepn. | 1 day after | Imm. after soln. prepn |
| Performance result | Peel-off force (N/cm) | | 2.4< | 2.4< | 0.3 | 0.3 | 2.4< | 2.4< | 2.4< | 2.4< | 0.01 | Coating not poss. | 0.6 |
| | Odor | | 3 | 4 | 5 | 5 | 5 | 5 | 5 | 5 | 5 | | 5 |
| | Blocking | | 2 | 2 | 3 | 4 | 2 | 2 | 2 | 2 | 3 | | 1 |

EXPLANATION OF REFERENCE NUMERALS AND SYMBOLS

12: recording medium, 14: undercoat composition coating roller, 17: exposure light source for semi-curing undercoat composition, 18K, 18C, 18M, 18Y, 18W: inkjet head, 20K, 20C, 20M, 20Y: exposure light source for semi-curing, 22: nitrogen-purged exposure light source unit, 24: outfeed roller, 26: wind-up roller, 28: nip roll

What is claimed is:

1. An inkjet recording method comprising, in order, as step a an application step of providing an undercoat layer by applying an undercoat composition onto a recording medium, as step b an image formation step of forming an image by discharging an ink composition onto the undercoat layer, as step c a curing step of irradiating the undercoat layer and the ink composition with actinic radiation so as to carry out curing, the undercoat composition comprising an isocyanate group-containing compound, a radically polymerizable monomer, and a radical polymerization initiator, and the ink composition comprising a radically polymerizable monomer, a radical polymerization initiator, and a colorant.

2. The inkjet recording method according to claim 1, wherein the content of a polyfunctional ethylenically unsaturated compound in the undercoat composition is at least 70 mass % relative to the total content of the radically polymerizable monomer, and the content of a polyfunctional ethylenically unsaturated compound in the ink composition is at least 70 mass % relative to the total content of the radically polymerizable monomer.

3. The inkjet recording method according to claim 1, wherein the ink composition and the undercoat composition comprise an acylphosphine compound as the radical polymerization initiator.

4. The inkjet recording method according to claim 1, wherein in step a the undercoat composition is applied onto the recording medium within one day after preparation.

5. The inkjet recording method according to claim 1, wherein it is for package printing.

6. The inkjet recording method according to claim 1, wherein the recording medium is a resin film that has a film thickness of 10 to 90 μm and has an image formation face comprising at least one type of resin selected from the group consisting of polyethylene, polypropylene, polyethylene terephthalate, and nylon.

7. The inkjet recording method according to claim 1, wherein it further comprises, as step d subsequent to step c, a lamination step of forming an adhesive layer and a laminate film above the image.

8. The inkjet recording method according to claim 2, wherein the ink composition and the undercoat composition comprise an acylphosphine compound as the radical polymerization initiator.

9. The inkjet recording method according to claim 2, wherein in step a the undercoat composition is applied onto the recording medium within one day after preparation.

10. The inkjet recording method according to claim 2, wherein it is for package printing.

11. The inkjet recording method according to claim 2, wherein the recording medium is a resin film that has a film thickness of 10 to 90 μm and has an image formation face comprising at least one type of resin selected from the group consisting of polyethylene, polypropylene, polyethylene terephthalate, and nylon.

12. The inkjet recording method according to claim 2, wherein it further comprises, as step d subsequent to step c, a lamination step of forming an adhesive layer and a laminate film above the image.

* * * * *